US005186196A

United States Patent [19]

Gorka et al.

[11] Patent Number: 5,186,196

[45] Date of Patent: Feb. 16, 1993

[54] BEVERAGE SHADER

[76] Inventors: Karl Gorka, 910 Highmeyer Rd., Harborcreek, Pa. 16421; Curt J. Smith, 56 East Dr., Erie, Pa. 16511

[21] Appl. No.: 714,636

[22] Filed: Jun. 13, 1991

[51] Int. Cl.[5] ..... A45B 3/00

[52] U.S. Cl. ..... 135/16; 135/20.1; 135/96; 220/703; 248/311.2; 248/364; 206/217

[58] Field of Search ..... 135/16, 20.1, 90, 96, 135/15.1; 220/694, 703; 206/217; 248/311.2, 364

[56] References Cited

U.S. PATENT DOCUMENTS

| | | | |
|---|---|---|---|
| 2,199,915 | 5/1940 | Howard | 135/96 X |
| 3,330,950 | 7/1967 | Lawson et al. | 248/364 X |
| 3,486,514 | 12/1969 | Prescott | 135/90 |
| 4,596,370 | 6/1986 | Adkins | 248/311.2 |
| 4,624,275 | 11/1986 | Baldwin | 135/19.5 |
| 5,002,081 | 3/1991 | Stromeyer | 135/90 X |
| 5,102,002 | 4/1992 | Whitley | 220/703 X |
| 5,115,939 | 5/1992 | Porter | 220/703 X |

FOREIGN PATENT DOCUMENTS

| | | | |
|---|---|---|---|
| 0507673 | 1/1956 | Italy | 135/90 |

*Primary Examiner*—Richard E. Chilcot, Jr.
*Assistant Examiner*—Lan M. Mai
*Attorney, Agent, or Firm*—Ralph Hammar

[57] ABSTRACT

A holder for an individual open top beverage container with an umbrella pivoted to the holder which is biased to a protective position over the top of the container when the holder is supported on a table or the like and is tilted out of the way when the holder is tilted to drinking position.

2 Claims, 1 Drawing Sheet

BEVERAGE SHADER

This invention is a holder for a beverage container in which an umbrella swings over the top of the container when the holder is resting on a table or the like and swings out of the way when the holder is tilted to a drinking position.

Figure 1:
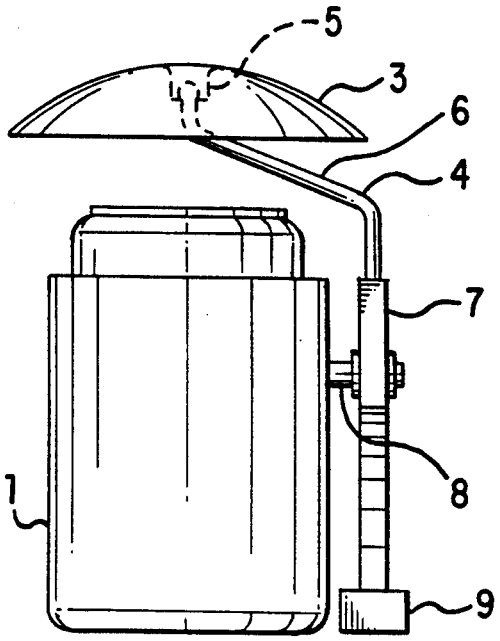
FIG. 1 is a front elevation of the holder.
Figure 2:
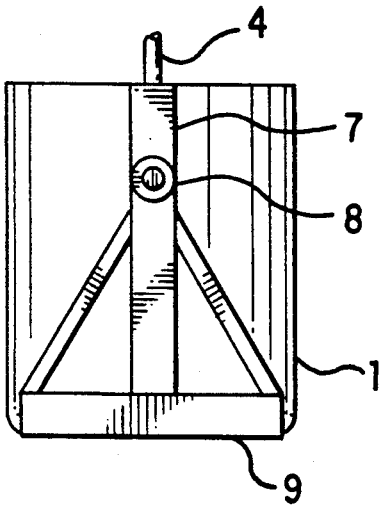
FIG. 2 is a side elevation partly broken away.
Figure 3:
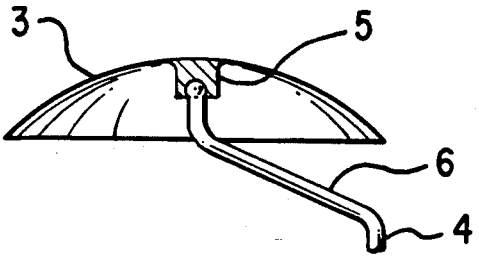
FIG. 3 is a detail of the swivel connection between the umbrella and its supporting arm.
Figure 4:
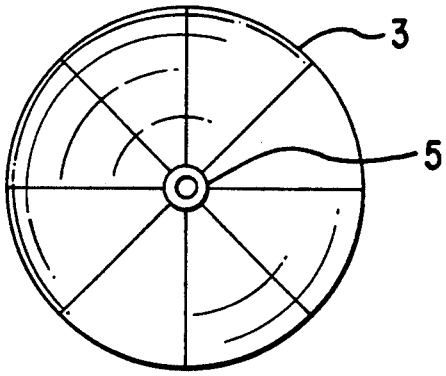
FIG. 4 is a top plan view of the umbrella.

Referring to the drawing, the numeral 1 indicates an insulated holder for a beverage can or other beverage container. The holder has a flat bottom resting on a supporting surface. At the top of the container is an umbrella 3 connected to the upper end of supporting arm 4 by a swivel joint 5 which allows the umbrella to be tilted as desired. The supporting arm for the umbrella is connected to the swivel joint by an offset section 6 in the supporting arm which clears the beverage container. The lower end of the arm is a vertical section 7 which pivots on a horizontal stub shaft 8 fixed to the holder 1. A counter weight 9 holds the supporting arm 4 in an upright position. When the beverage holder 1 is tilted to drinking position, the umbrella remains in the upright position so that the tilting of the beverage container provides clearance between the container and the umbrella. From the point of view of the user, the umbrella tilts out of the way.

We claim:

1. A beverage shader comprising a holder for receiving an upright open top beverage container, an umbrella spaced above and extending over said open top, a support for said umbrella having a pivot, said support having a lower section and an upper section offset through the space between the umbrella and the open top of said container and connected in supporting relation to said umbrella, and means for maintaining said umbrella support in an upright position while said beverage container is tilted to drinking position.

2. The structure of claim 1 in which said means is a counter weight on the support below its pivot.

* * * * *